US006128997A

United States Patent [19]

Nitschmann

[11] Patent Number: 6,128,997

[45] Date of Patent: Oct. 10, 2000

[54] CUTTING ASSEMBLY FOR A MOTOR CHAINSAW

[75] Inventor: Karl Nitschmann, Schorndorf, Germany

[73] Assignee: Andreas Stihl AG & Co., Germany

[21] Appl. No.: 09/298,581

[22] Filed: Apr. 23, 1999

[30] Foreign Application Priority Data

Apr. 25, 1998 [DE] Germany ..... 198 18 652

[51] Int. Cl.[7] ..... B27B 33/14

[52] U.S. Cl. ..... 83/832; 30/383

[58] Field of Search ..... 30/381–387; 83/830–834

[56] References Cited

U.S. PATENT DOCUMENTS

| | | | |
|---|---|---|---|
| 2,622,636 | 12/1952 | Cox . | |
| 2,725,083 | 11/1955 | Ackley | 83/834 |
| 2,730,143 | 1/1956 | Ryde | 83/834 |
| 2,832,380 | 4/1958 | Crowe . | |
| 5,029,501 | 7/1991 | Smith | 83/830 |

FOREIGN PATENT DOCUMENTS

| | | | |
|---|---|---|---|
| 371252 | 9/1963 | Switzerland | 83/830 |

*Primary Examiner*—Douglas D. Watts

*Attorney, Agent, or Firm*—Robert W. Becker & Associates

[57] ABSTRACT

A cutting assembly for a motor chainsaw has a guide bar with peripheral guide groove and guide surfaces. A saw chain circulates in the guide groove in a longitudinal direction of the guide bar. The saw chain has chain members such as centrally arranged drive members and connectors, laterally connecting the drive members. Some of the connectors and some of the drive members are embodied as cutters arranged alternatingly on opposite sides of the saw chain. Rivets connect the chain members pivotably to one another and extend transversely to the circulating direction. The drive members engage the guide groove and the connectors are slidably supported on the guide surfaces. Each cutter has a base, a support stay connected to the base, and a cutting tooth connected to the support stay. The cutting tooth has a laterally projecting roof portion having a leading end in the circulating direction with a roof cutting edge. The support stay has a first portion positioned in a central plane defined by the drive members, and the roof portion projects in a direction of the cutting plane of the saw chain in which direction the base also faces. The roof portion has an outer angled edge extending in the circulating direction parallel to the base. The angled edge has a lateral cutting edge positioned in front of the roof cutting edge in the circulating direction.

18 Claims, 5 Drawing Sheets

CUTTING ASSEMBLY FOR A MOTOR CHAINSAW

BACKGROUND OF THE INVENTION

The present invention relates to a cutting assembly for a motor chainsaw comprising a guide bar with a peripheral guide groove and a saw chain circulating in the guide groove in the longitudinal direction of the guide bar. The saw chain is comprised of centrally arranged drive members and has laterally positioned connecting members including cutters with cutting teeth that are alternatingly positioned to the right and to left of the saw chain. All chain members are connected pivotably to one another by rivet bolts that extend transverse to the circulating direction of the saw chain. The drive members have projections engaging the guide groove, while the cutters and connectors are slidingly supported on guide surfaces positioned laterally adjacent to the guide groove. Each one of the cutters has a base with a support stay for a cutting tooth. The support stay has a laterally projecting roof portion extending transversely to the chain circulating direction and having a roof cutting edge which is positioned at the leading end in the chain circulating direction.

From U.S. Pat. No. 2,832,380 a saw chain is known which has divided cutting teeth. One cutting tooth is embodied as a leading lateral cutting edge and has coordinated therewith too following cutting teeth with roof cutting edges and a further cutting tooth member positioned on the opposite longitudinal side of the cutting chain that has a lateral cutting edge. Since the cutting members in the longitudinal direction of the cutting chain are positioned at a spacing to one another the cut for removing a cutting is carried out in sequential steps which is unfavorable with respect to the efficiency of the saw chain as well as with respect to removal of the cuttings.

From U.S. Pat. No. 2,622,636 a saw chain with shaving teeth arranged to the right and to the left of the saw chain is known. The teeth are respectively embodied with angled cutting roof portions extending across the longitudinal center axis of the saw chain and supported on support stays at the outer longitudinal side. The support stays, extending in the longitudinal direction of the saw chain, form together with adjacently arranged support stays for the cutting teeth almost a type of partition, especially when taking into consideration the very high chain speed of 20 m/sec. This "partition" must be overcome when the cuttings are to be removed laterally. This results in efficiency losses.

It is therefore an object of the present invention to embody a cutting assembly of the aforementioned kind such that with a minimal output a high cutting efficiency can be realized.

SUMMARY OF THE INVENTION

This object is inventively solved in that the support stays of the cutters are positioned substantially in the plane of the drive members of the saw chain and that the laterally projecting roof portion projects in a direction of a cutting plane of the saw chain in which direction the base also faces. The lateral projecting roof portion has an outer angled edge extending in the chain circulating direction parallel to the base. The outer angled edge has a lateral cutting edge positioned in front of the roof cutting edge in the circulating direction.

The saw chain circulating on the guide bar thus does not impede the lateral cuttings removal because the constructive arrangement of the support stays results in their arrangement in a row behind one another in the circulating direction of the saw chain. In the area of the longitudinal center plane of the saw chain a series of adjacently arranged support stays results when the saw chain circulates which must not be overcome for a lateral cuttings removal. The cutting tooth arrangement at the outer side of the base that supports it results in a direct removal of the cutting to the outer side of the saw chain.

Since the outer edge of the laterally projecting roof portion faces away from the support stay and since the angled edge has a lateral cutting edge, positioned in front of the roof cutting edge, this tooth shape ensures timely complete cutting at the outer side of the saw chain at which the base of the cutting tooth is positioned. This tooth shape ensures a simultaneous removal of the resulting cuttings to the outer side of the saw chain. The lateral removal of the cuttings cannot be impeded by a following cutter. The leading lateral cutting edge cuts the cuttings such that they are laterally removed and the resulting cuttings are then cut off in the longitudinal direction of the cuttings from the material to be cut. With a minimal drive output a high cutting efficiency results.

The support stay is positioned expediently in the area of the plane of the drive member above this drive member, whereby in the embodiment of the connector as a cutter the support stay is angled toward the longitudinal center plane of the saw chain. The cutters in the circulating direction of the saw chain are alternatingly positioned to the right and to the left of this longitudinal center plane.

Advantageously, the drive member itself can be a cutter whereby a first cutter has a laterally projecting roof portion extending toward one outer longitudinal side and a subsequently arranged cutter has a laterally projecting roof portion extending to the other outer longitudinal side of the saw chain.

For limiting the thickness of the cuttings and for reducing the danger of kick-back, it can be advantageous to arrange a depth limiter in front of the laterally projecting roof portion, respectively, in front of the lateral cutting edge. Expediently, for the lateral cutters the depth limiter is bent in the direction toward the saw chain center plane so that the depth limiters, arranged to the right and to the left of the saw chain, in the circulating direction of the saw chain are substantially arranged in a row behind one another. The bent portion is advantageously selected such that the depth limiter and the support stays in the circulating direction of the saw chain are arranged in a row so that the lateral cuttings removal occurs without chain members interfering.

In a further embodiment of the invention a cuttings limiter can be arranged adjacent to the cutter for limiting the cuttings thickness. It has a support surface that extends below the laterally projecting roof portion. It may be expedient in this context to embody the support surface of the cuttings limiter, facing the bottom of the cutting groove, so as to slant upwardly counter to the circulating direction of the chain in order to counteract, for continuous resharpening of the saw chain, the increasing aggressiveness of the cutting engagement resulting from the different tooth wear. For realizing an excellent lateral guiding action, the cuttings limiter is mounted at the support stay of the cutter whereby the cuttings limiter is preferably embodied at the laterally positioned connecting members. Expediently, a unitary embodiment of the cuttings limiter with the cutter, for example, as a stamped or crimped portion of the support stay, can be provided.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

Figure 1:
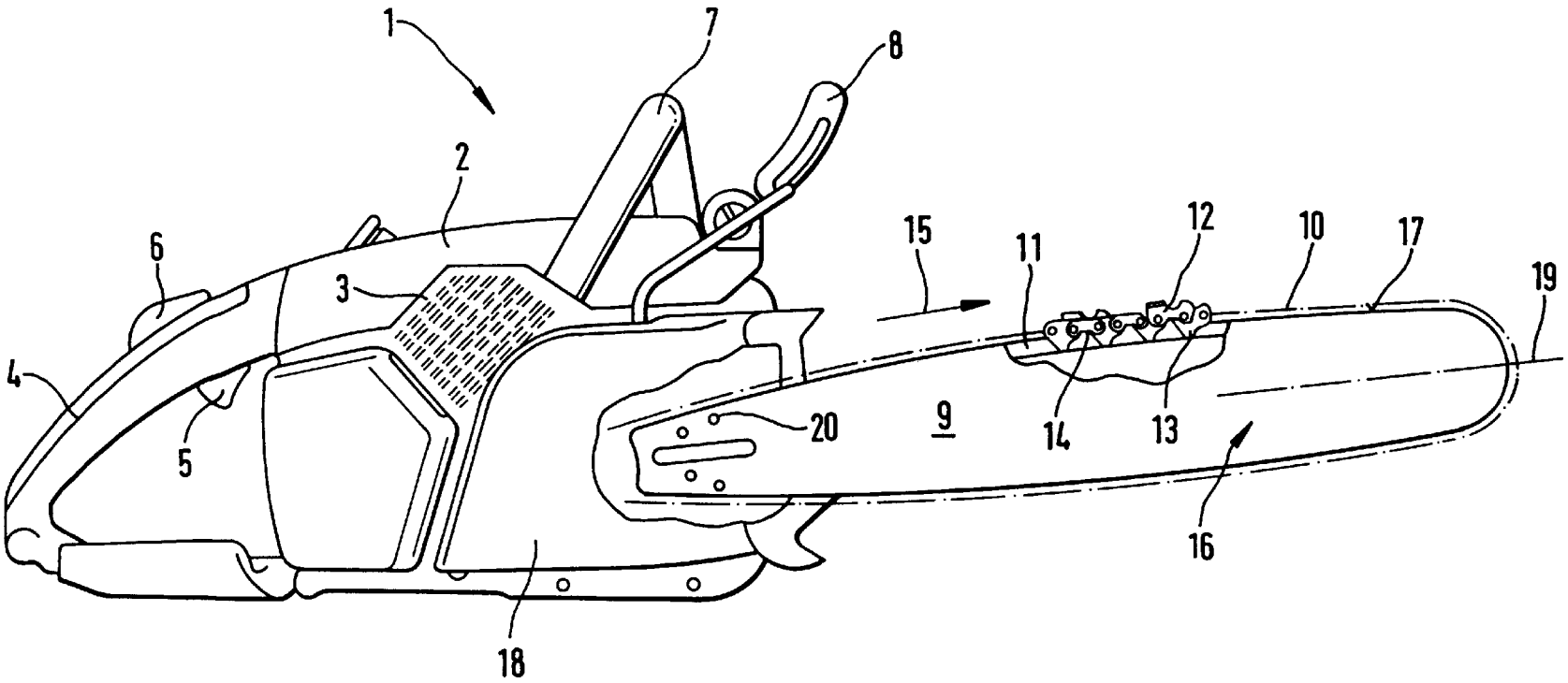
FIG. 1 is a schematic representation of the inventive cutting assembly of a motor chainsaw.

The present invention will now be described in detail with the aid of several specific embodiments utilizing FIGS. 1 through 12.

The inventive cutting assembly 16 for a motor chainsaw 1 is comprised of a guide bar 9 with a guide groove 11 arranged at its outer periphery in which the projections of centrally arranged drive members 13 of a saw chain 10 are engaged. The saw chain 10 is comprised of centrally arranged drive members 13, lateral connectors 14 and further lateral connectors 14 alternatingly arranged, for example, to the right and to the left of the saw chain 10 and embodied as cutters 12. The saw chain is driven in circulation in the longitudinal direction (axis 19) by a drive wheel which is covered by the cover 18 on the guide bar 9. The chain is guided by the drive members 13 engaging the guide groove 11 and thus secured at the guide bar 9. The connectors 14, respectively, cutters 12 arranged laterally adjacent to the drive members 13 are slidingly supported on guide surfaces 17 positioned adjacent to the guide groove 11. For reducing friction between the saw chain 10 and the guide bar 9, a lubricant is introduced into the guide groove 11 via an oil bore 20, whereby preferably a biologically degradable oil is used.

The drive wheel positioned under the cover 18 is driven by an internal combustion engine 3 which is arranged in a housing 2 of the motor chainsaw 1. The housing 2 has a rear grip 4 as well as an upper bracket-shaped grip 7. Both grips 4, 7 are designed for carrying and guiding the motor chainsaw. In the direction of the guide bar 9 a protector 8 is arranged in front of the upper grip 7 by which a non-represented safety brake device for the saw chain 10 can be actuated. The rear grip 4 is provided with the throttle 5 for the internal combustion engine. The throttle 5 has correlated therewith a throttle lock 6.

Figure 2:
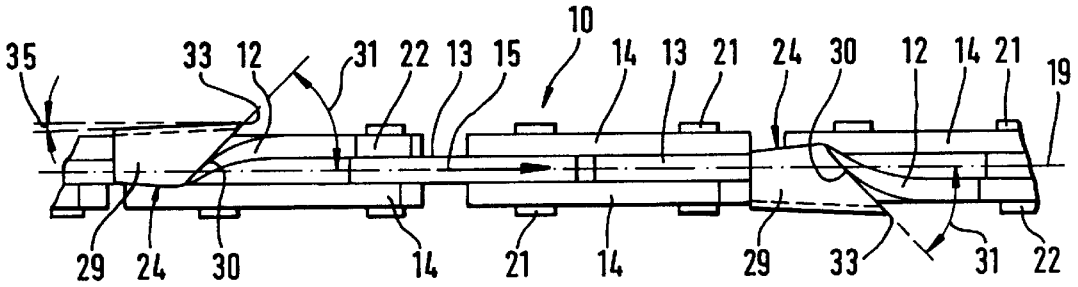
FIG. 2 is a plan view onto the saw chain according to FIG. 1.
Figure 3:
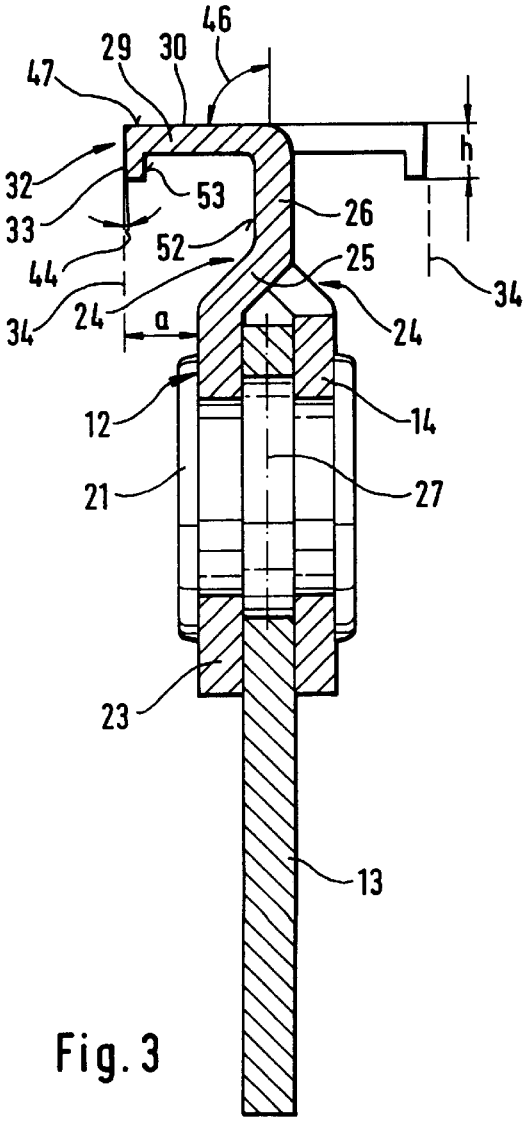
FIG. 3 is a sectional view of the saw chain of FIG. 1.
Figure 4:
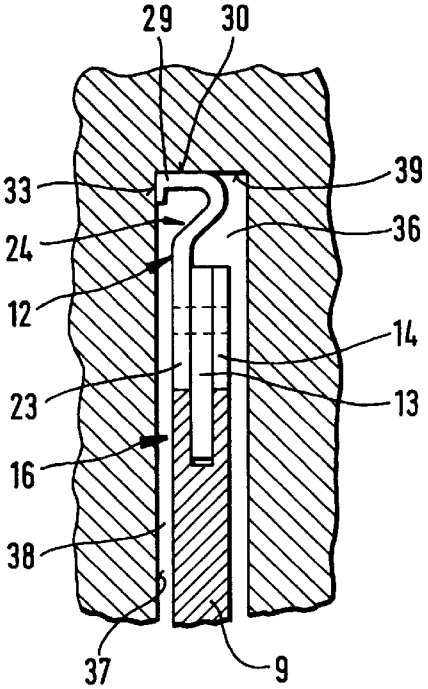
FIG. 4 is a schematic representation of the inventive cutting assembly in a cutting groove.

The construction of the saw chain 10 of the cutting assembly 16 can be seen in detail in FIGS. 2 through 4. The drive members 13 and the connectors 14 are pivotably connected to one another by rivet bolts 21 which extend transverse to the circulating direction 15 of the saw chain 10. The drive members 13 as well as the connectors 14 can be embodied as cutters having cutting portions 12 which are positioned alternatingly to the right and the left at the outer side of the saw chain relative to the center plane 27.

In FIG. 3, a lateral connector 14 is embodied as a cutter 12. Each cutter 12 is comprised of a plate-shaped base 23 which is penetrated by the rivet bolt 21. At a rear portion of the base 23, relative to the circulating direction of the saw chain 10, a support stay 24 is provided as a unitary part which has a bent portion 25 and a support portion 26. The bent portion 25 is formed by a single bending of the support stay 24 in the direction toward the center plane 22 of the saw chain and by a further return bend so that the support portion 26 adjacent to the bent portion 25 is positioned substantially in the plane 27 of the plate-shaped base 23 above the drive member 13. In the shown embodiment according to FIG. 3, the support portion 26 of the support stay 24 is positioned exactly in the center plane 27. It may be expedient when the support stay 24 is slanted toward the opposite lateral connector 14 of the other longitudinal outer side of the saw chain, for example so as to have an outwardly open angle 28 of, for example, 10° relative to the center plane 27 of the drive member 13 (see FIG. 5). Preferably, a complete overlap of the support stays 24 is realized as can be seen in FIG. 3. For this purpose, the support portions 26 of the support stays 24 are respectively positioned in the plane 27 of the drive members 13.

A laterally projecting roof portion 29 is connected at a right angle to the support portion 26 of the support stay 24 which is positioned above the plate-shaped base 23 and projects to the outer side of the saw chain 10 where the base 23 of the laterally projecting roof portion 29 is also positioned. Preferably, the roof surface 47 facing away from the saw chain 10 extends transversely to the longitudinal direction 15 at a substantially right angle 46 to the plane 27 of the drive member 13, while in the longitudinal circulating direction 15 a small clearance angle of, for example, 7° is provided. The forward edge of the laterally projecting roof portion 29, relative to the circulating direction 15, forms a roof cutting edge 30 which relative to the longitudinal center axis 19 of the saw chain 10 defines an angle of approximately 30° to 35° opening in the circulating direction 15. This roof cutting edge 30 extends from the support stay 24 across the base 23 in the direction toward the outer side of the saw chain at which the base 23 is positioned. The side of the base 23 facing away from the drive member 13 is positioned so as to face the outer side of the saw chain 10, whereby the outer side of the saw chain is defined by its cutting plane 34. The angled edge 32 of the laterally projecting roof portion 29 bent in the direction toward the outer side 34 of the saw chain extends in the longitudinal direction (axis 19) of the saw chain and is angled such that it is approximately parallel to the plate-shaped base 23. It forms a lateral cutting edge 33 which is positioned in front of the roof cutting edge 30 in the circulating direction 15 of the saw chain. As can be seen in FIG. 3, the lateral cutting edge 33 is positioned at a lateral spacing "a" measured transverse to the longitudinal direction (axis 19) to the base 23 and determines, as is shown in FIG. 4, the outer cutting plane 34 of the saw chain 10. The angled edge 32 is positioned at a clearance angle 44 of, for example, 2° to 3° to the cutting plane 34.

The height h of the lateral cutting edge 33 is selected to match the thickness of the cuttings to be produced. Preferably, the height h is slightly larger than the necessary cutting thickness.

Figure 10:
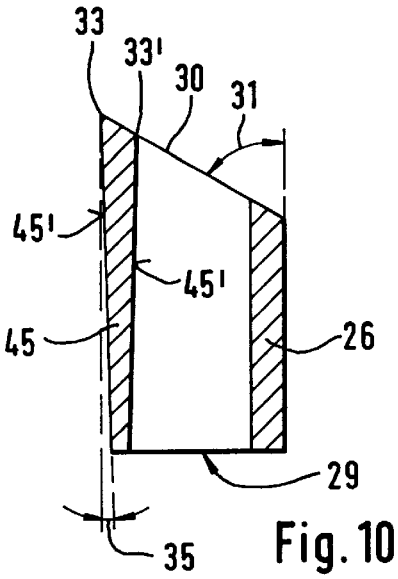
FIG. 10 shows a section of the cutting member along the line X—X of FIG. 7.
Figure 7:
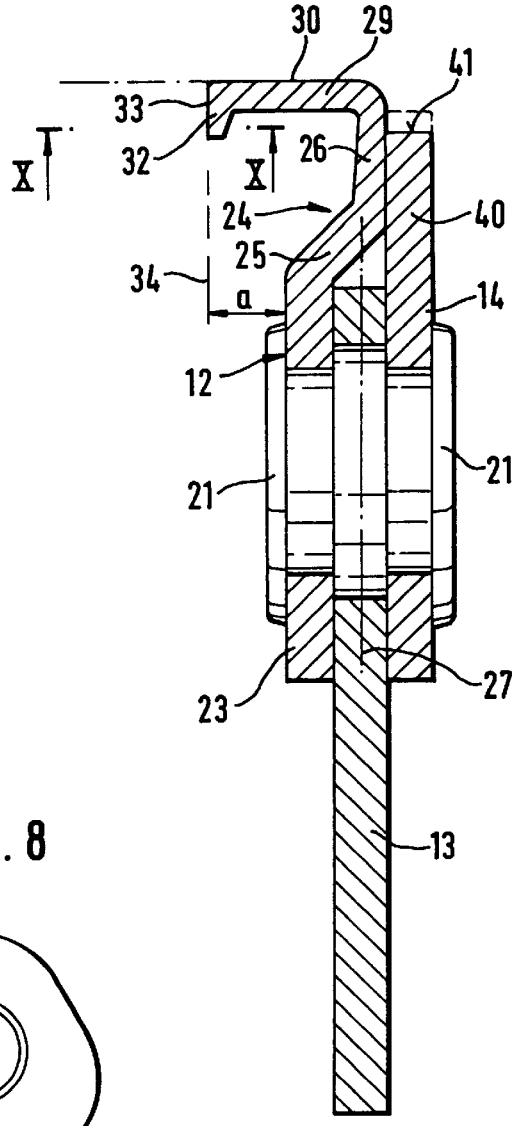
FIG. 7 is a section of a saw chain with a cutting tooth according to FIG. 5 and a cuttings limiter arranged thereat.

As can be seen in FIG. 10, the angled edge 32 forms a rib 45 in the longitudinal direction (axis 19) of the saw chain 10 that is positioned in a lateral clearance angle 35 of, for example, 3° to 4° to the outer side 34 of the saw chain. The rib 45 advantageously tapers in a direction counter to the circulating direction 15.

The support stays 24 of the cutters 12, which are preferably alternatingly positioned to the right and to the left of the saw chain 10 in the circulating direction 15, are positioned in the circulating direction 15 of the saw chain 10 approximately in a row behind one another whereby the design of the cutting tooth of the cutter 12 enables a lateral cuttings removal to the outside (longitudinal side) of the saw chain 10 correlated with the cutter 12 which has cut the cuttings to be removed. The cuttings removal thus takes place directly in the direction of the lateral wall 37 of the cutting groove without the cutting having to cross the longitudinal center plane 27 of the saw chain. Expediently, the support stay 24 can be angled relative to the longitudinal direction 19 of the saw chain.

As a cuttings limitation, for realizing a sufficiently quiet run and for avoiding kickback effects, each cutter 12 can have correlated therewith a depth limiter 22 (FIG. 2) positioned in front of the lateral cutting edge 33 and roof cutting edge 30. It may be expedient for the laterally arranged cutters 12 that the depth limiter 22 is bent similarly to the support stay 24 toward the center plane of the saw chain 10 so that the depth limiter 22 of the cutters 12, positioned to the right and to the left of the saw chain 10, in the circulating direction 15 of the saw chain 10 are positioned in a row behind one another. The design is advantageously selected such that the depth limiter 22 as well as the support stays 24 of the cutters 12 are positioned in a row behind one another in the circulating direction 15 of the saw chain, preferably so as to be congruent.

As is shown in FIG. 4, the leading lateral cutting edge 43 will cut the cuttings laterally, and the following roof cutting edge 30 will cut in the longitudinal direction of the cutting groove 36. The spacing "a" of the lateral cutting edge 33 from the plate-shaped base 23 results in a gap 38 during cutting between the guide bar 9 and the sidewall 37. The gap 38 prevents, on the one hand, a jamming of the cutting assembly 16 in the cutting groove 36 and, on the other hand, can provide an exit path for the cuttings directly after completion of the cutting action toward the outer side of the saw chain. In practice, it was found that even for wood having long fibers a sufficient and satisfactory cuttings removal without plugging of the cutting groove 36 can be realized.

Figure 5:
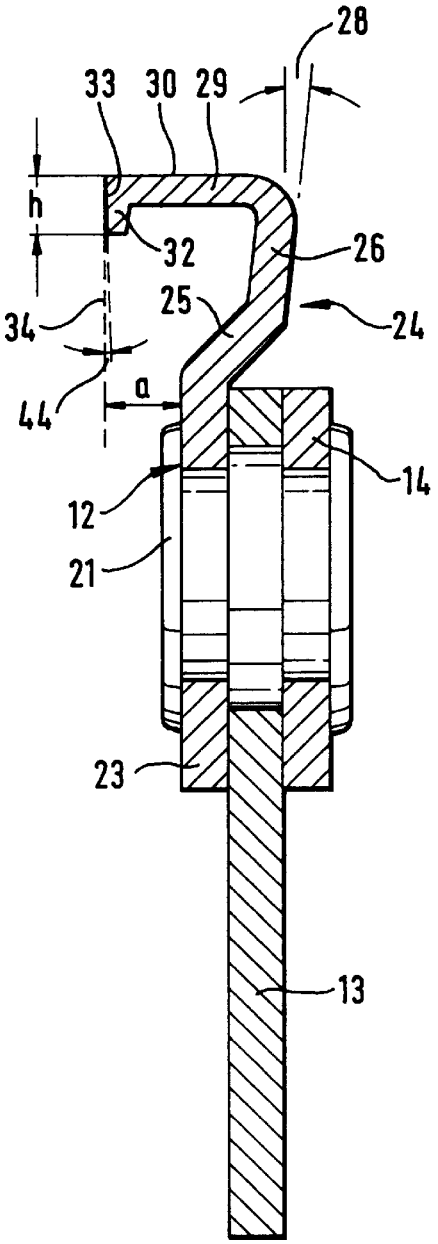
FIG. 5 is a section of the saw chain with a cutting tooth of a first embodiment.
Figure 6:
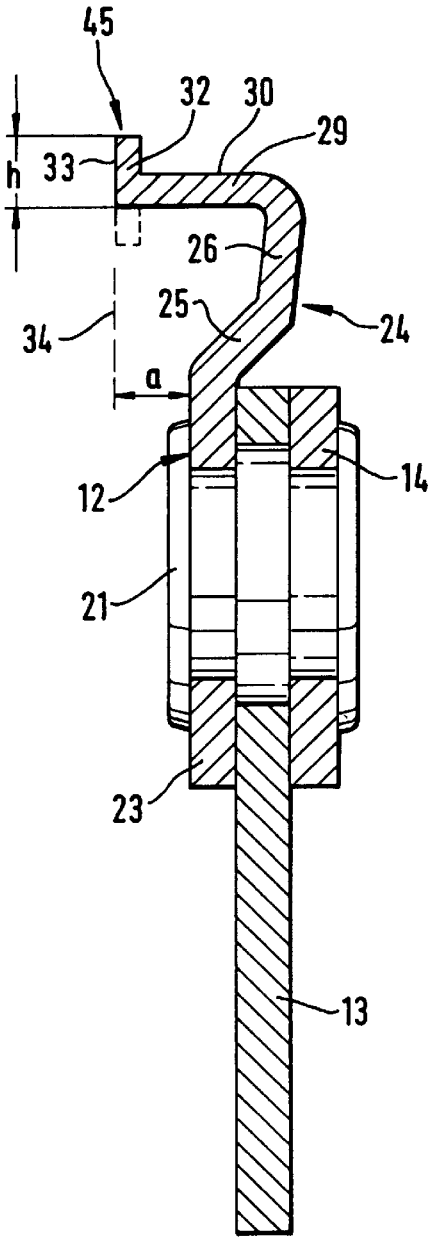
FIG. 6 is a section of the saw chain with a cutting tooth of a second embodiment.
Figure 11:
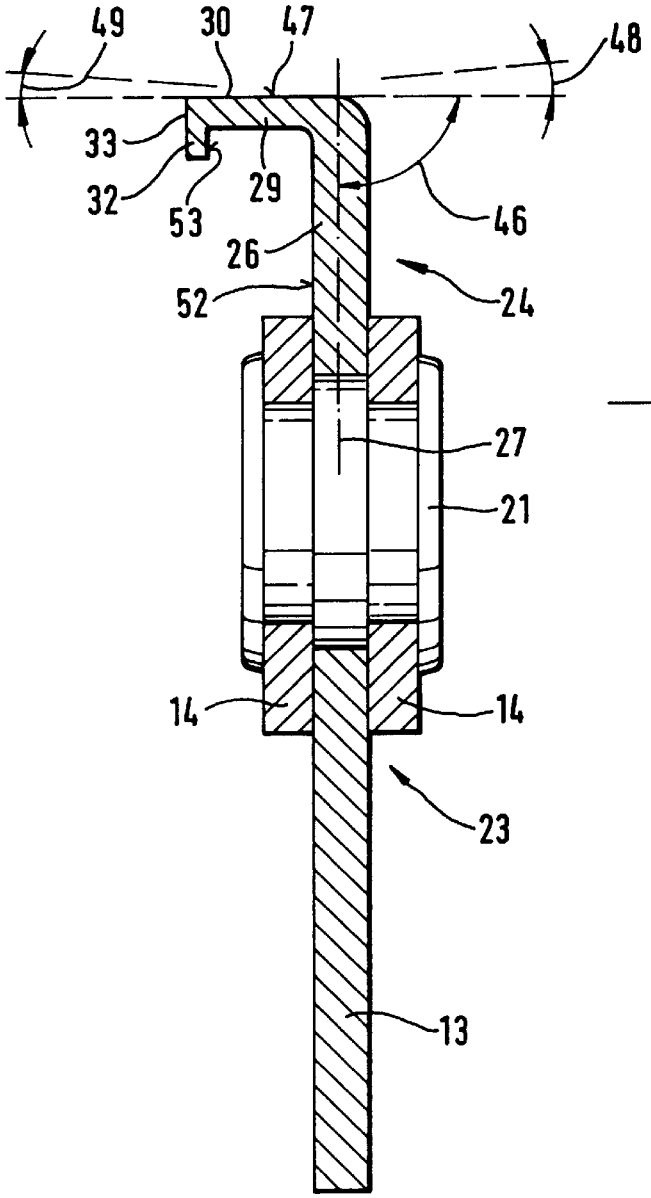
FIG. 11 is a section of the saw chain with a cutting tooth of a third embodiment.

FIGS. 5 and 6 show differently embodied cutters. In FIG. 5 the angled edge 32 of the laterally projecting roof portion 29 which forms the lateral cutting edge is angled toward the guide bar 9, respectively, the base 23, while in the embodiment according to FIG. 6 the angled edge 32 is pointing outwardly away at a right angle from the guide bar 9 and the base 23. In the embodiment according to FIG. 6, the lateral cutting edge 33 is positioned approximately parallel laterally adjacent to the plane of the plate-shaped base 23 and forms the outer cutting plane 34 of the saw chain 10 whereby a clearance angle 44 of, for example, 2° to 3° to the cutting plane 34 is realized. Advantageously, the inner surface 53 of the angled edge 32 facing the support stay 24 is approximately parallel to the facing outer surface 52 of the support portion 26 (FIGS. 3 and 11).

While in the embodiment according to FIG. 5 the lateral cutting edge 33 has a continuous transition into the roof cutting edge 30, in the embodiment according to FIG. 6 the lateral cutting edge 33 and the roof cutting edge 30 have no such continuous transition. The embodiment according to FIG. 6 provides an advantageous cutting behavior of the saw chain in that the angled edge 32 of the laterally projecting roof portion 29 provides a projecting rib which, before the roof cutting edge 30 becomes effective, will engage the material to be cut, for example, wood, so that a guide function in the longitudinal direction of the saw chain 10 is provided. A slipping of the motor chainsaw when starting the cut is thus almost completely prevented. When, moreover, the rib 45, according to the representation in FIG. 10, tapers in a direction counter to the circulating direction 15 of the saw chain 10, at both longitudinal sides 45' of the rib a clearance angle 35 can be provided so that the leading inner edge of the rib 45 can be provided with a lateral cutting edge 33'. In this case, a smooth, continuous transition from the cutting edge 33 into the roof cutting edge 30 is also realized. As can be seen especially in FIG. 6, the edge 32 can be upset in the plane of the roof surface 47, respectively, the laterally projecting roof portion 29 so that a portion is formed which extends substantially parallel to the base 23 and at which the lateral cutting edge 33 is to be formed.

In order to be able to limit the cutting engagement of the inventively embodied cutter 12, in a further embodiment of the invention a cuttings limiter 40 is provided at the level of the laterally projecting roof portion 29 adjacent to the cutter 12. The cuttings limiter 40 determines the thickness of the cuttings. The cuttings limiter 40 has a support surface 41 facing the bottom 39 of the cutting groove 36. This support surface 41, limits the cutting penetration of the roof cutting edge 30 into the material to be cut. The support surface 41 extends approximately parallel to the roof surface 47. It may be advantageous to arrange the support surface 41 facing the bottom 39 of the cutting groove 36, at an upward slant counter to the circulating direction 15 of the saw chain 10, as is indicated in a dashed line in FIG. 7.

Figure 8:
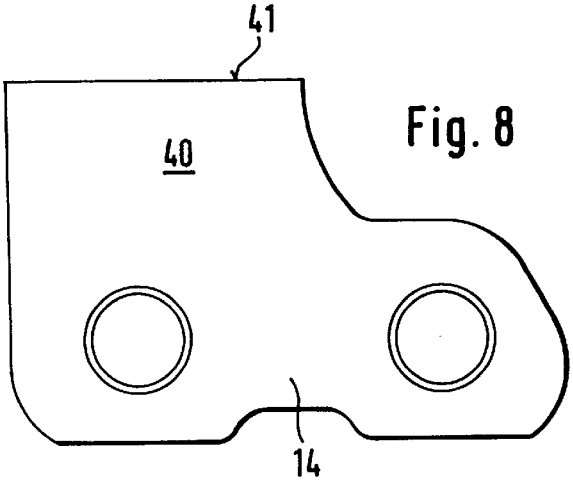
FIG. 8 is a side view of a cutting limiter of a first embodiment.
Figure 9:
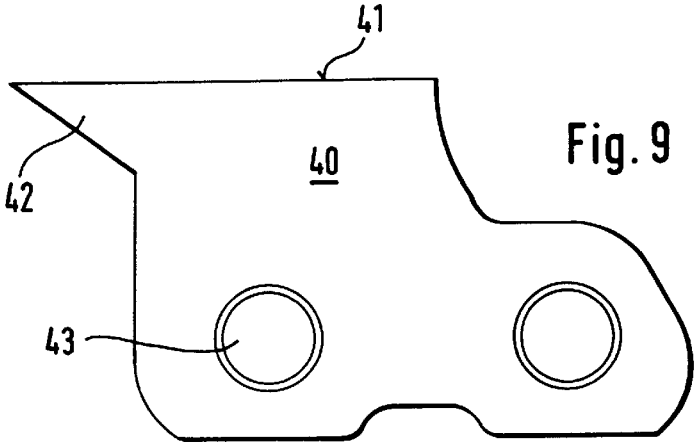
FIG. 9 is a side view of a cuttings limiter of a second embodiment.

Advantageously, the cuttings limiter 40 rests at the support stay 24, especially at the support portion 26, whereby the cuttings limiter 40 as well as the support portion 26 of the support stay 24 are positioned expediently parallel to the center plane 27 of the drive member 13. The cuttings limiter 40 in the shown embodiment is a plate-shaped element embodied together with the connector 14. Examples of the contour of the cuttings limiter 40 are shown in FIGS. 8 and 9. According to FIG. 9 a projection 42 is provided as an extension of the support surface 41 of the cuttings limiter 40. It extends counter to the circulating direction 15 of the saw chain 10. This projection 42 is positioned relative to the circulating direction 15 at a spacing to the rivet opening 43 upstream thereof. This causes, during circulation of the saw chain at the tip of the guide bar 9, a positioning of the projection 42 in the direction toward the groove bottom 39 so that the kickback tendency is reduced.

In the embodiment according to FIG. 11 the drive member 13 is embodied as a cutter 12. For identical parts the same reference numerals are used. The support stay 24, respectively, the support portion 26 are positioned in the plane 27 of the base 23 whereby the roof portions 29 of the sequentially arranged cutters 12 are positioned alternatingly to the right and to the left of the longitudinal center plane 27. For an improved guiding of the saw chain 10 in the cutting groove 36, it may be advantageous to embody the roof surface 47, respectively, the roof cutting edge 30 transverse at an angle to the longitudinal chain direction. Advantageously, an angle 49 opening or closing toward the angled edge 32 of approximately 3° to 10° is provided. Expedient is an angle 48 that opens toward the support stay 24 and is approximately 3° to 10°.

Figure 12:
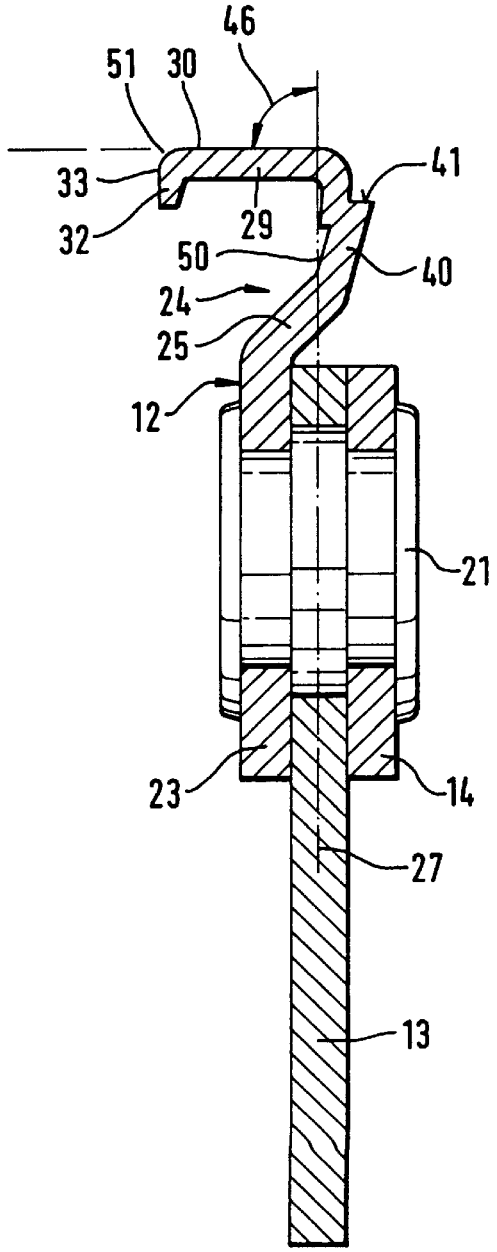
FIG. 12 is a section of the saw chain with a cutting tooth of a fourth embodiment.

The embodiment according to FIG. 12 corresponds substantially to the embodiment of FIG. 5. For limiting the thickness of the cuttings a cuttings limiter 40 is embodied as a unitary part of the cutter 12 which is formed as a crimped or stamped portion 50 at the support stay 24. The crimped or stamped portion is realized at the side of the support stay 24 or the support portion 26 facing the angled edge 32 whereby the support surface 41 is substantially parallel to the roof portion 29, respectively, its roof surface 47. The lateral cutting edge 43 has a rounded cutting transition 51 into the roof cutting edge 30.

The inventive saw chain can be used, depending on the selected cutting tooth geometry, in various embodiments, for example, without cuttings limiter, only with depth limiter or only with cuttings limiter, or with a depth limiter as well as a cuttings limiter, whereby the latter combination can be designed such that a first limitation is provided by the depth limiter and a second limitation is provided by the cuttings limiter. Constructively, this can be achieved by a respective size selection of the depth limiter whereby the depth limiter, in the most favorable case, should not wear over the service life of the chain, but only the cuttings limiter should be size-reduced during resharpening of the saw chain.

During resharpening of the cutters, due to the inventive design, the removal at and the shape of the cuttings limiter 40 can be determined by respectively positioning and guiding the round sharpening surface. When the center point of the file diameter is above the support surface 41, the leading edge is dulled. No cutting edge can be formed.

The specification incorporates by reference the disclosure of German priority document 198 18 652.5 of Apr. 25, 1998.

The present invention is, of course, in no way restricted to the specific disclosure of the specification and drawings, but also encompasses any modifications within the scope of the appended claims.

What is claimed is:

1. A cutting assembly (16) for a motor chain saw, said cutting assembly (16) comprising:

a guide bar (9) having a peripheral guide groove (11) and guide surfaces (17) adjacent to said guide groove (11);

a saw chain (10) circulating in said guide groove (11) in a longitudinal direction of said guide bar (9);

said saw chain (10) comprised of chain members (12, 13, 14), said chain members comprising centrally arranged drive members (13) and connectors (12, 14) laterally connecting said drive members (13); wherein some of sad connectors and/or some of said drive members (13) are embodied as cutters having cutting portions (12) arranged alternatingly on opposite sides of said saw chain (10) in a circulating direction (15) of said saw chain (10);

rivets (21) connecting said chain members (12,13,14) pivotably to one another and extending in a direction transverse to said circulating direction (15);

said drive members (13) engaging said guide groove (11);

said connectors (12, 14) slidingly supported on said guide surfaces (17);

each one of said cutters (12) comprised of a base (23), a support stay (24) connected to said base (23), and a cutting tooth (29, 30) connected to said support stay (24);

wherein said cutting tooth has a laterally projecting roof portion (29), having a leading end in said circulating direction (15), and a roof cutting edge (30) positioned at said leading end, wherein said support stay (24) has a first portion (26) positioned in a central plane (27) defined by said drive members (13), and wherein said laterally projecting roof portion (29) projects in a direction of a cutting plane (34) of said saw chain (10) in which direction said base (23) faces;

wherein said laterally projecting roof portion (29) has an outer angled edge (32) extending in said circulating direction (15) parallel to said base (23);

wherein said outer angled edge (32) has a lateral cutting edge (33) positioned in front of said roof cutting edge (30) in said circulating direction (15).

2. A cutting assembly according to claim 1, wherein said support stay (24) has a second portion (25) outwardly from said first portion and connecting said support stay (24) to said base (23).

3. A cutting assembly according to claim 2, wherein said second portion (25) is slanted toward one of said connectors (14) positioned opposite said cutter (12) and defines an outwardly open angle (28) relative to said central plane (27).

4. A cutting assembly according to claim 1, wherein each one of said cutters (12) has a depth limiter (22) positioned in front of said roof cutting edge (30) and said lateral cutting edge (33) in said circulating direction (15).

5. A cutting assembly according to claim 4, wherein said depth limiters (22) at least on one side of said saw chain (10)

relative to said central plane (27) are aligned sequentially in said circulating direction (15).

6. A cutting assembly according to claim 4, wherein said depth limiters (22) are aligned sequentially in said circulating direction (15) and said support stays (24) are aligned sequentially in said circulating direction (15).

7. A cutting assembly according to claim 1, wherein said outer angled edge (32) is angled toward said guide bar (9).

8. A cutting assembly according to claim 7, wherein said outer angle edge (32) has a free end and wherein said free end is upset in a direction toward a plane (47) of said laterally projecting roof portion (29).

9. A cutting assembly according to claim 1, wherein said outer angled edge (32) is angled away from said guide bar (9).

10. A cutting assembly according to claim 9, wherein said outer angle edge (32) has a free end and wherein said free end is upset in a direction toward a plane of said laterally projecting roof portion (29).

11. A cutting assembly according to claim 1, wherein said outer angled edge (32) has a height (h) substantially matching a thickness of cuttings produced by said saw chain (10).

12. A cutting assembly according to claim 1, further comprising a cuttings limiter (40) for each one of said cutters (12), wherein said cuttings limiter (40) limits a thickness of cuttings produced by said saw chain (10) and is arranged adjacent to said cutter (12), said cuttings limiter (40) having a support surface (41) positioned below said laterally projecting roof portion (29) and facing a bottom (39) of a cutting groove (36) cut by said saw chain (10), wherein said support surface (41) is slanted upwardly in said circulating direction (15).

13. A cutting assembly according to claim 12, wherein said support surface (41) is slanted upwardly or downwardly in said circulating direction (15).

14. A cutting assembly according to claim 12, wherein cuttings limiter (40) rests at said support stay (24) of said cutter (12).

15. A cutting assembly according to claim 14, wherein said cuttings limiter (40) is an integral part of said connector (14).

16. A cutting assembly according to claim 12, wherein said cuttings limiter (40) is a unitary part of said cutter (12).

17. A cutting assembly according to claim 16, wherein said cuttings limiter (40) is a stamped portion or a crimped portion of said first portion (26) of said support stay (24).

18. A cutting assembly according to claim 12, wherein said cuttings limiter (40) has a projection (42) provided as an extension of said support surface (41) extending counter to said circulating direction (15).

* * * * *